US009981774B2

(12) United States Patent
Park

(10) Patent No.: US 9,981,774 B2
(45) Date of Patent: May 29, 2018

(54) CONTAINER FORMED WITH FOLDABLE AND STACKABLE CONTAINER BODIES

(71) Applicant: INPACK GLOBAL CO., LTD., Changwon-si, Kyungnam (KR)

(72) Inventor: Young-Seok Park, Gimhae-si (KR)

(73) Assignee: INPACK GLOBAL CO., LTD., Changwon-si, Kyungnam (KR)

( * ) Notice: Subject to any disclaimer, the term of this patent is extended or adjusted under 35 U.S.C. 154(b) by 31 days.

(21) Appl. No.: 13/710,587

(22) Filed: Dec. 11, 2012

(65) Prior Publication Data

US 2014/0083896 A1 Mar. 27, 2014

(30) Foreign Application Priority Data

Sep. 27, 2012 (KR) ..... 10-2012-107642

(51) Int. Cl.
*B65D 21/00* (2006.01)
*B65D 85/62* (2006.01)
(Continued)

(52) U.S. Cl.
CPC ..... *B65D 21/0228* (2013.01); *B65D 19/0012* (2013.01); *B65D 19/18* (2013.01); *B65D 21/083* (2013.01); *B65D 2519/00034* (2013.01); *B65D 2519/00069* (2013.01); *B65D 2519/00174* (2013.01); *B65D 2519/00268* (2013.01); *B65D 2519/00278* (2013.01); *B65D 2519/00288* (2013.01); *B65D 2519/00308* (2013.01); *B65D 2519/00318* (2013.01); *B65D 2519/00343* (2013.01); *B65D 2519/00363* (2013.01); *B65D 2519/00502* (2013.01);
(Continued)

(58) Field of Classification Search
CPC ..... B65D 21/0228; B65D 21/023; B65D 19/0012; B65D 19/18; B65D 21/083; B65D 2519/00308; B65D 2519/00363; B65D 2519/00502; B65D 2519/00641; B65D 21/00; B65D 85/62
USPC ..... 206/531, 509, 600, 386, 503, 508; 108/53.1, 54.1, 55.3; 220/1.5, 23.2, 23.6, 220/4.31
See application file for complete search history.

(56) References Cited

U.S. PATENT DOCUMENTS 5,372,257 A * 12/1994 Beauchamp et al. ..... 206/504
5,725,118 A * 3/1998 Slager et al. ..... 220/4.28
(Continued)

*Primary Examiner* — J. Gregory Pickett
*Assistant Examiner* — Rafael Ortiz
(74) *Attorney, Agent, or Firm* — Muncy, Geissler, Olds & Lowe, P.C.

(57) ABSTRACT

A container includes a pallet having a plurality of elongated grooves of predetermined pattern in the upper surface of the pallet, and at least one stackable container body formed with a wall member, the bottom edge surfaces having a plurality of protrusions formed thereon, the top edge surfaces having a plurality of slots formed therein at a corresponding location with the protrusions to allow one container body to stack on another container body with the protrusions of one container body inserted into the slots of the other container body. The container body includes a folding configuration at its side surfaces thereof to allow the container body to fold to reduce its size, wherein the elongated grooves of the pallet are configured to receive the protrusions of the container body both in the unfolded (original) shape and the folded shape.

10 Claims, 6 Drawing Sheets

(51) Int. Cl.

| | |
|---|---|
| ***B65D 21/02*** | (2006.01) |
| ***B65D 19/00*** | (2006.01) |
| ***B65D 19/18*** | (2006.01) |
| ***B65D 21/08*** | (2006.01) |

(52) U.S. Cl.
CPC ..... *B65D 2519/00592* (2013.01); *B65D 2519/00641* (2013.01); *B65D 2519/00805* (2013.01); *B65D 2519/00915* (2013.01); *B65D 2519/00995* (2013.01)

(56) References Cited

U.S. PATENT DOCUMENTS

| | | | | |
|---|---|---|---|---|
| 5,829,595 | A * | 11/1998 | Brown et al. | 206/600 |
| 6,173,659 | B1 * | 1/2001 | Danks et al. | 108/54.1 |
| 6,367,631 | B1 * | 4/2002 | Steigerwald | 206/509 |
| 6,776,300 | B2 * | 8/2004 | Walsh et al. | 220/6 |
| 6,874,637 | B2 * | 4/2005 | Pigott et al. | 206/600 |
| 7,264,122 | B2 * | 9/2007 | Koefelda et al. | 206/600 |
| 7,293,509 | B2 * | 11/2007 | Hassell | 108/56.3 |
| 2004/0020821 | A1 * | 2/2004 | Koefelda et al. | 206/600 |
| 2004/0026283 | A1 * | 2/2004 | Pigott et al. | 206/386 |
| 2004/0211776 | A1 * | 10/2004 | Stevenson | B65D 11/1893 220/4.28 |
| 2007/0170085 | A1 * | 7/2007 | Hoogland | 206/600 |
| 2007/0199845 | A1 * | 8/2007 | Hartwall | B65D 19/0026 206/386 |
| 2009/0127158 | A1 * | 5/2009 | Apps | 206/600 |
| 2011/0108549 | A1 * | 5/2011 | Mitchell et al. | 220/1.5 |
| 2012/0126954 | A1 * | 5/2012 | Kail et al. | 340/10.6 |
| 2012/0152799 | A1 * | 6/2012 | Ficker | 206/600 |
| 2012/0223812 | A1 * | 9/2012 | Kail et al. | 340/10.1 |
| 2012/0241350 | A1 * | 9/2012 | Stahl | 206/509 |

* cited by examiner

CONTAINER FORMED WITH FOLDABLE AND STACKABLE CONTAINER BODIES

REFERENCE TO RELATED APPLICATIONS

This application claims the priority benefit of Korean Patent Application No. 10-2012-107642 filed on Sep. 27, 2012, the entire contents of which are incorporated herein by reference.

FIELD OF THE INVENTION

The present invention relates to a container or package box, and more particularly, to a container having a plurality of container bodies configured to be stacked to meet the volume of the items to be accommodated therein and also foldable to reduce its sizes for collection.

BACKGROUND OF THE INVENTION

According to conventional practices, package boxes for export are individually made in accordance with the sizes and kinds of items accommodated thereinto, and alternatively, regular sizes of package boxes are made.

If items like fruits and vegetables are put in the regular sizes of package boxes in the conventional practices, however, a lot of time for packing them in the package boxes is needed due to given heights of the boxes, without having any damage to them.

So as to solve the above problems, multistage boxes have been proposed, and a variety of brackets and fastening members for fastening the neighboring multistage boxes have been accordingly disclosed. Korean Patent Application Laid-Open No. 10-2012-0028161 discloses folding type bracket for package box, thereby ensuring the fastening and rigidity of the multistage boxes, but, unfortunately, it needs a lot of time for fastening and separating the multistage boxes.

Further, Korean Patent No. 10-1099427 discloses folding type delivery assembling box, which is used when package boxes are collected.

The present invention is proposed to avoid the inconveniences in the fastening and separating processes of the multistage boxes suffered in Korean Patent No. 10-1121894 issued to the same applicant as this invention.

Moreover, there is a definite need for development of a new package box capable of easily discharging bulk freight (for example, grain, coal, and oil), bolts and nuts, and liquid therefrom.

SUMMARY OF THE INVENTION

Accordingly, the present invention has been made in view of the above-mentioned problems occurring in the prior art, and it is an object of the present invention to provide a container formed with foldable and stackable container bodies that is capable of reducing the time consumed for fastening and separating the container bodies to and from one another and that is capable of preventing the container bodies from being separated during the delivery thereof.

It is another object of the present invention to provide a container that is capable of preventing the container bodies multi-staged on top of each other from being moved or slid due to the vibrations occurring during the delivery.

It is still another object of the present invention to provide a container that is capable of easily discharging bulk freight (for example, grain, coal, and oil), bolts and nuts, and liquid therefrom.

To accomplish the above objects, according to the present invention, there is provided a container having a pallet with an RFID chip mounted thereon, a plurality of containers bodies multi-staged on top of the pallet, and a cap adapted to cover the top end edges of the containers bodies, the containers body including: one-touch brackets disposed on each containers body to perform fastening and separation of the containers bodies to and from each other; protrusions formed on the underside edges of the pallet; a hopper stopper disposed on the center of the top surface of the pallet; and a plurality of elongated grooves arranged on the top surface of the pallet in such a manner as to engage with protruding plates formed from the underside edges of each container body.

Preferably, so as to perform the fastening and separation between the container bodies, each container body has a plurality of one-touch fastening slots formed on the top edges thereof, each one-touch fastening slot having an inclined surface, and each one-touch bracket having a guide rail embedded in the side portion of each container body, a fastening member coupled to the guide rail, and an elastic member attached to one side of the guide rail to restore the guide rail to its original position.

Preferably, the container according to the present invention further includes a hopper connected to the hopper stopper of the pallet in such a manner as to be mounted inside the container bodies.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE INVENTION

Hereinafter, an explanation on a container formed with foldable and stackable container bodies according to the preferred embodiments of the present invention will be in detail given with reference to the attached drawings, but the present invention is not necessarily limited thereto.

Just the contents added to Korean Patent No. 10-1121894 issued to the same Applicant as this invention are disclosed in the preferred embodiment of the present invention, and so as to perform the fastening and separation of a plurality of foldable and stackable container bodies with ease, accordingly, one-touch brackets are provided.

According to the present invention, further, a plurality of elongated grooves are formed on the top end of a pallet, so that the container bodies can be collected without any cap, and projections are formed on the underside edges of the pallet, so that the container can be delivered without any escape and movement.

According to the present invention, additionally, a hopper is attached to the inside of the container, and a hopper stopper is formed on the pallet, thereby easily discharging bulk freight, bolts and nuts, fruits, vegetables, and liquid therefrom.

Figure 1:
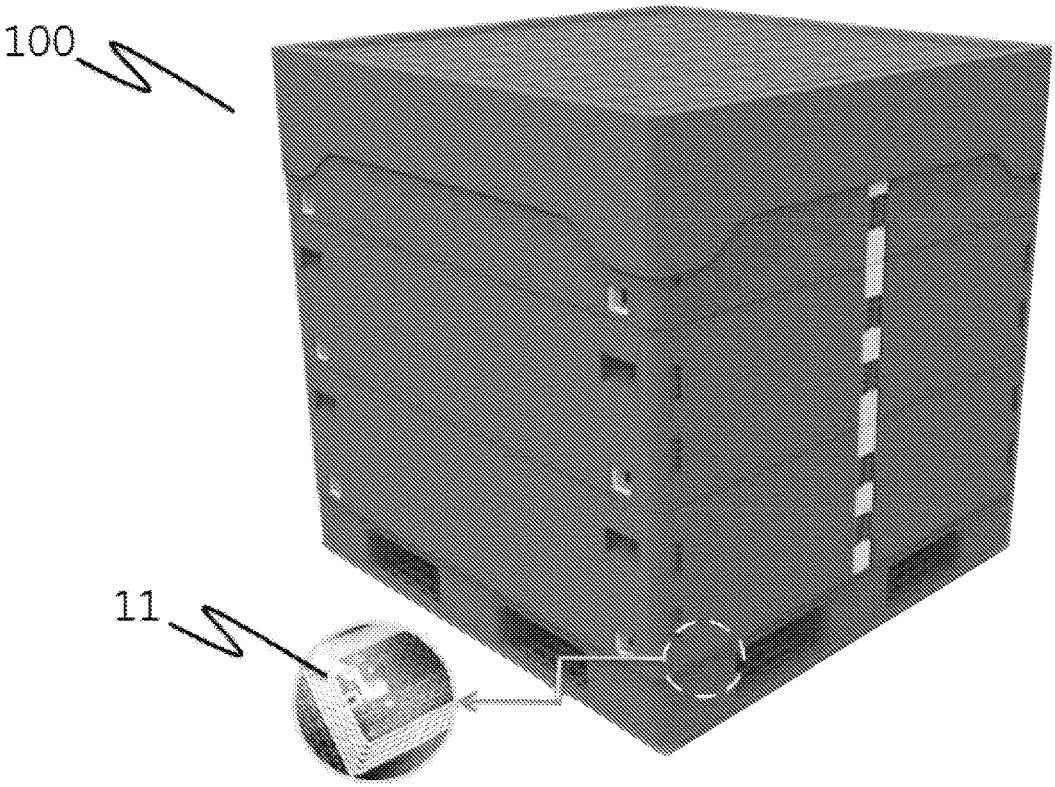
FIG. 1 is a perspective view showing a container formed with foldable and stackable container bodies according to the present invention.
Figure 2:
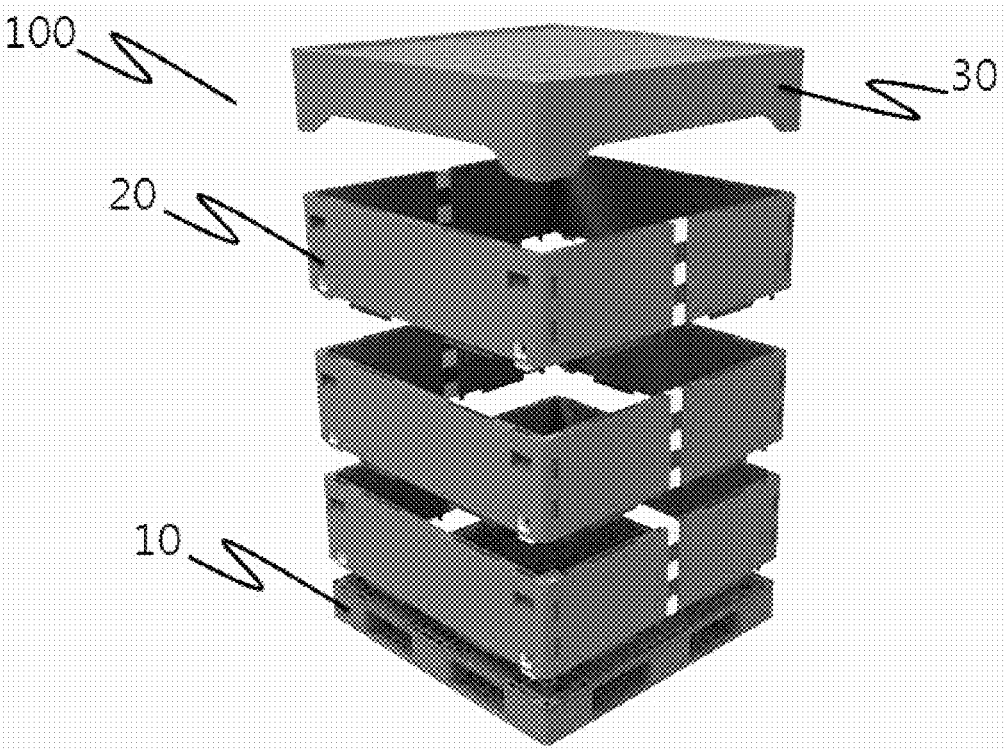
FIG. 2 is a perspective view showing the separated state of the container formed with foldable and stackable container according to the present invention.
Figure 3:
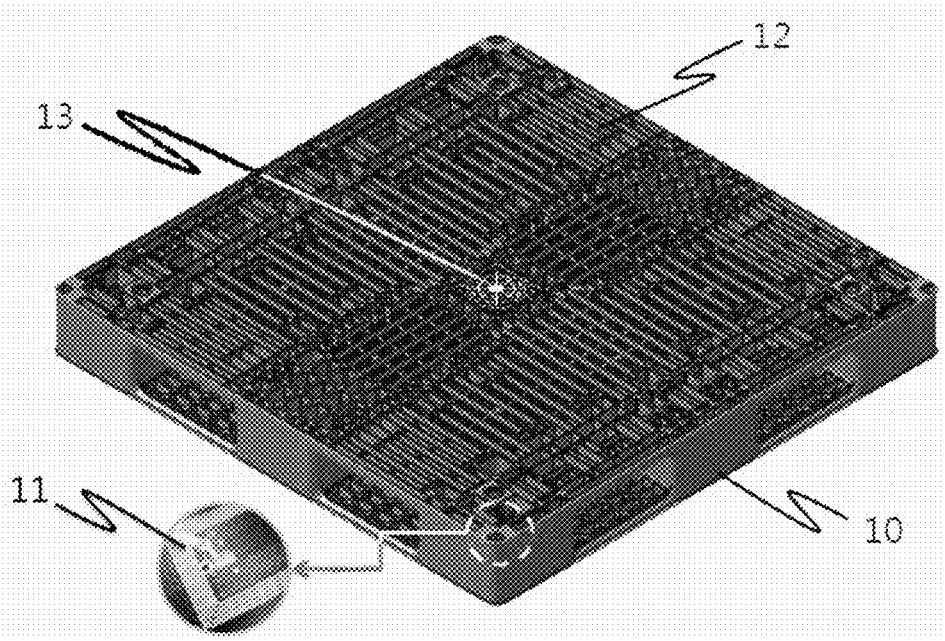
FIG. 3 is a perspective view showing the pallet of the container formed with foldable and stackable container bodies according to the present invention.
Figure 4:
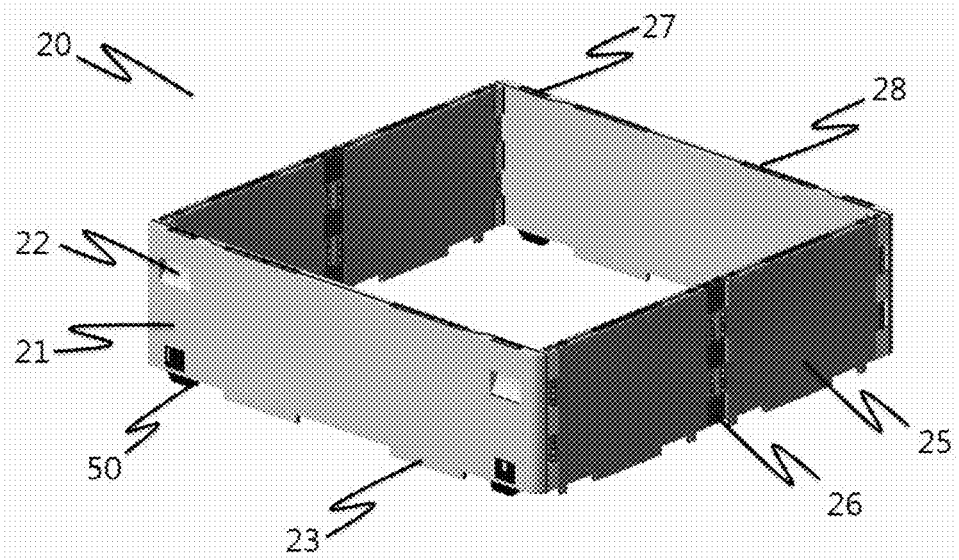
FIG. 4 is a perspective view showing each container body box of the container formed with foldable and stackable container bodies according to the present invention.
Figure 5:
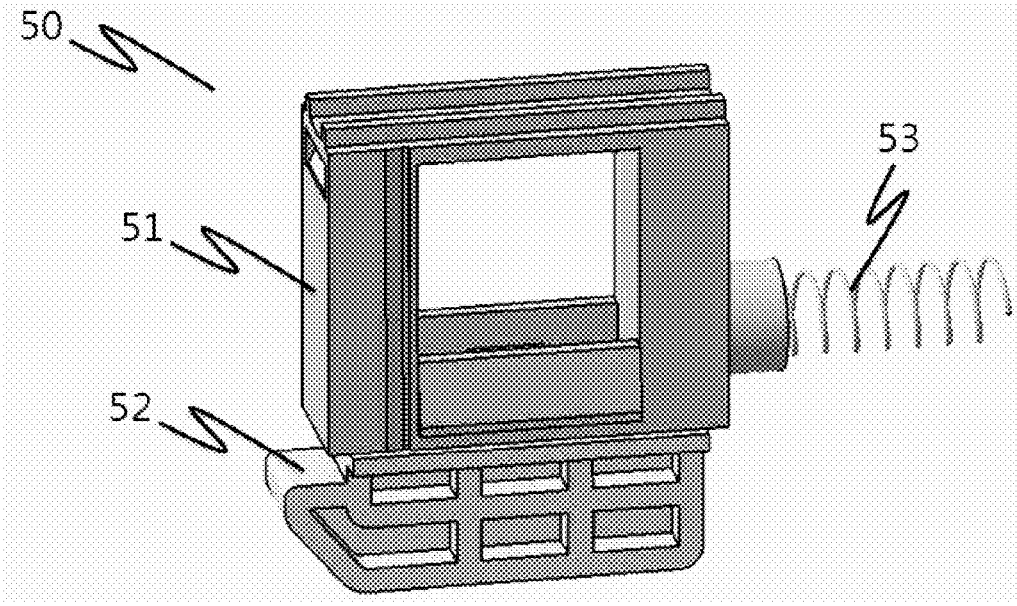
FIG. 5 is a perspective view showing each one-touch bracket of container body according to the present invention.
Figure 6:
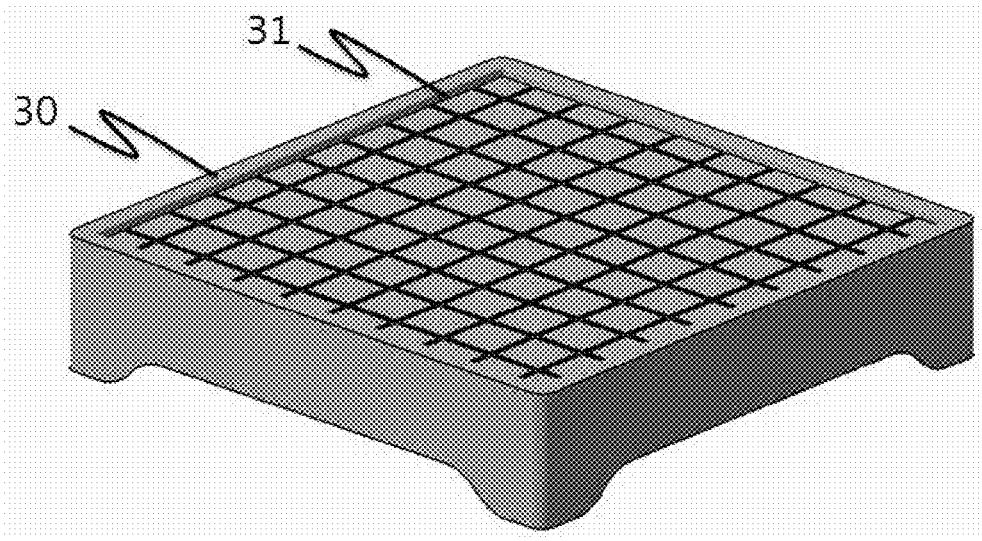
FIG. 6 is a perspective view showing the cap of the container formed with foldable and stackable container bodies according to the present invention.

FIG. 1 is a perspective view showing a container according to the present invention, FIG. 2 is a perspective view showing the separated state of the container according to the present invention, FIG. 3 is a perspective view of the pallet, FIG. 4 is a perspective view of each container body, FIG. 5 is a perspective view of each one-touch bracket, and FIG. 6 is a perspective view of the cap.

According to the present invention, there is provided a container 100 having a pallet 10 with an RFID chip 11 mounted thereon, a plurality of container bodies 20 multi-staged on top of the pallet 10, and a cap 30 adapted to cover the top end edges of the container bodies 20 multi-staged, the container 100 including: one-touch brackets 50 mounted on each container body 20 to perform fastening and separation of the container bodies 20 to and from each other; protrusions 15 formed on the underside edges of the pallet 10; a hopper stopper 13 disposed on the center of the top surface of the pallet 10; and a plurality of elongated grooves 12 arranged on the top surface of the pallet 10 in such a manner as to engage with a plurality of protruding plates 23 formed from the underside edges of each container body 20.

As shown in FIG. 2, each container body 20 has a shape of a square and includes two opposing side panels 21, front panels 25 hinge-coupled to both ends of each side panel 21, and a connector 26 hinge-coupled to the ends of the front panels and having a locking projection adapted to allow folding in one direction.

So as to enhance the fastening performance when the container bodies 20 are stacked on top of each other, the plurality of protruding plates 23 are formed on the underside edges of the side panels 21 and the front panels 25.

Also, a plurality of protruding slots 28 are desirably formed on the top edges of the side panels 21 and the front panels 25 in such a manner as to engage with the protruding plates 23.

Further, one or more grips 22 are desirably formed on one side of each side panel 21.

The protruding plates 23 and the protruding slots 28 serve to guide the fastening of the container bodies 20, but do not conduct their complete fastening.

Accordingly, so as to easily fasten and separate the container bodies 20, as shown in FIG. 5, the present invention includes: one-touch fastening slots 27 formed on one side of the top edges of each container body 20, each slot having an inclined surface; and the one-touch brackets 50 each having a guide rail 51 embedded in the side portion of each container body 20, a fastening member 52 coupled to the guide rail 51, and an elastic member 53 attached to one side of the guide rail 51 to restore the guide rail 51 to its original position.

Figure 7:
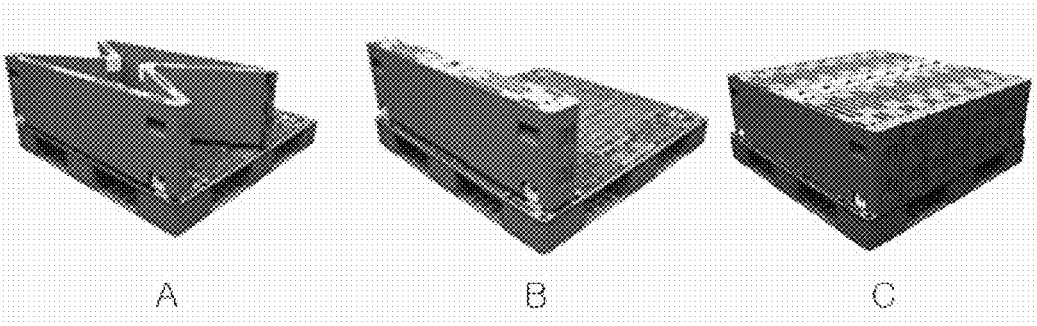
FIGS. 7A to 7C are perspective views showing the folding and collecting processes of the container bodies according to the present invention.
Figure 8:
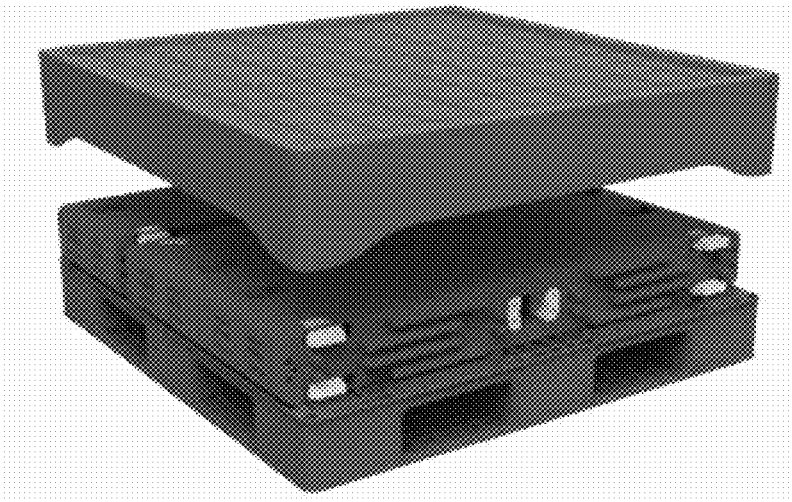
FIG. 8 is a perspective view showing the collecting results of package boxes according to conventional practices.
Figure 9:
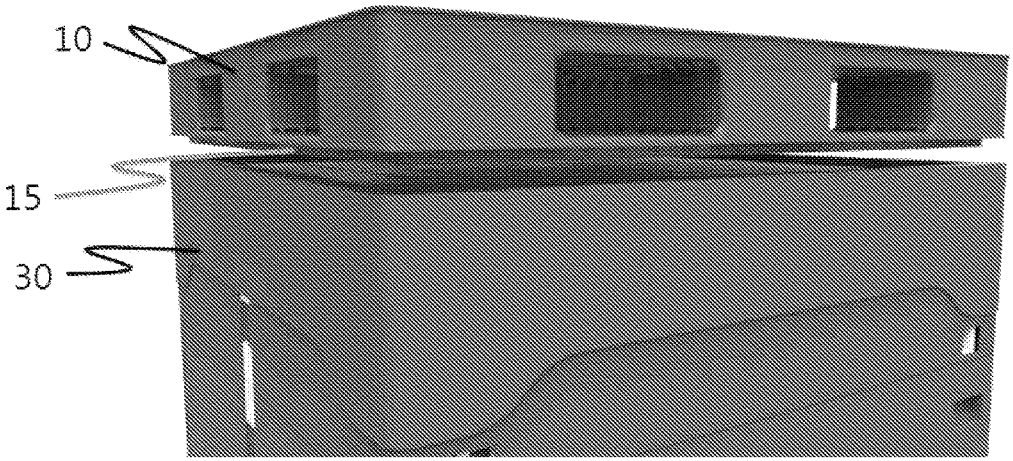
FIG. 9 is a perspective view showing the stacked state of the pallet and cap in the container formed with foldable and stackable container bodies according to the present invention.

FIGS. 7A to 7C are perspective views showing the folding and collecting processes of the container bodies according to the present invention, FIG. 8 is a perspective view showing the collecting results of package boxes according to conventional practices, and FIG. 9 is a perspective view showing the stacked state of the pallet and cap in the container according to the present invention.

According to the conventional practices, as shown in FIG. 8, so as to collect the package boxes, the cap 30 should be needed, and the number of container bodies stacked on top of each other is limitedly defined.

So as to solve the above-mentioned problem, accordingly, the present invention provides the plurality of elongated grooves 12 formed on the top surface of the pallet 10 in such a manner as to engage with the protruding plates 23 of each container body 20.

According to the present invention, accordingly, the container bodies 20 can be collected, without any cap 30 and having the limitation in the number thereof.

According to the conventional practices, the pallet has the flat underside edges, and thus, if the pallet is stacked on the adjacent cap of the package box, it slides or moves during the delivery, thereby causing the package boxes stacked on top thereof to fall down.

So as to solve the above-mentioned problems, as shown in FIGS. 6 and 9, the cap 30 has projections 31 formed on the top surface thereof in such a manner as to engage with each container body 20, and the pallet 10 has the projections 15 formed on the underside edges thereof in such a manner as to engage with each container body 20.

Accordingly, even though the container bodies 20 are stacked on the pallet 10 in the state where the cap 30 exists or does not exist, the sliding or movements of the container bodies 20 stacked on the top of the pallet 10 due to the vibrations generated during the delivery are prevented to completely avoid their falling.

Figure 10:
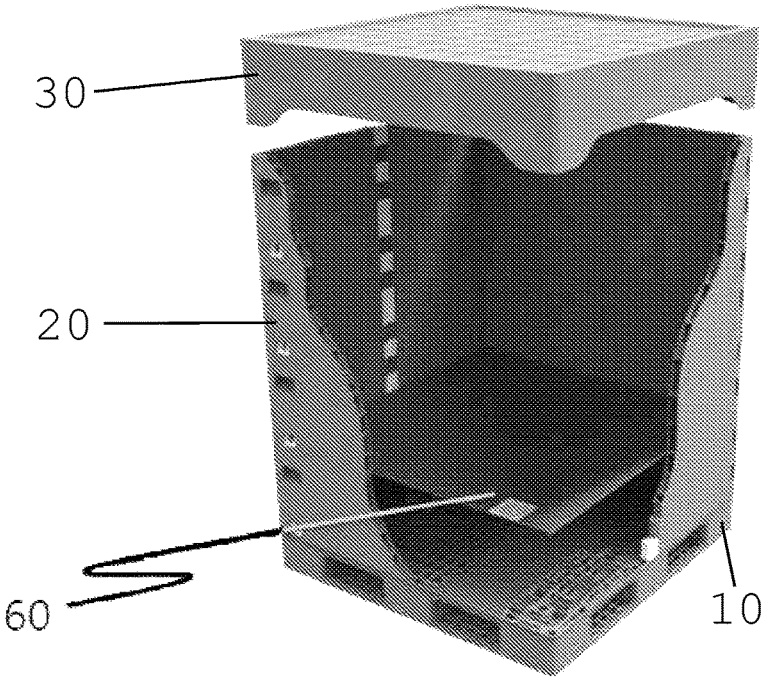
FIG. 10 is a perspective view showing the container formed with foldable and stackable container bodies according to the present invention, wherein a hopper is inserted thereinto in a state where one side is removed to see the inside thereof.

FIG. 10 is a perspective view showing the container according to the present invention, wherein a hopper is inserted thereinto in a state where one side is removed to see the inside thereof. As shown in FIG. 10, the present invention further includes a hopper 60 connected to the hopper stopper 13 of the pallet 10 in such a manner as to be mounted inside the container bodies 20.

The hopper 60 is used to easily discharge bulk freight (for example, grain, coal, and oil), bolts and nuts, liquid, chemical and plastic materials from the container bodies 20.

The hopper 60 is easily fastened and separated to/from the pallet 10, and if hoppers are stacked on top of each other upon collection, the cleanness and space utilization of the storage warehouse can be enhanced.

As set forth in the foregoing, there is provided the container for export that has the following advantages.

First, the plastic container according to the present invention has excellent durability and semi-permanent life term, and further, it has lower physical distribution cost when compared with one-time timber package boxes.

According to the present invention, further, the RFID chip is embedded in the pallet, so that the container of the present invention can be collected from everywhere in the world, which achieves the management of inflow/outflow, stock status, delivery tracking, and loss prevention.

According to the present invention, furthermore, each container body has one-touch brackets, which enables the time for assembling the container bodies to be shorter by two times than the conventional practice.

According to the present invention, additionally, the hopper is mounted on the hopper stopper disposed on the pallet, which allows bulk freight, bolts and nuts, fruits and vegetables, plastic raw materials, and liquid to be easily delivered.

According to the present invention, also, the container is made of a plastic material, which allows the manufacturing in accordance with the characteristics of the items to be accommodated therein, thereby easily achieving the storage and the checking of the stock status.

According to the present invention, lastly, the elongated grooves are formed on the pallet in such a manner as to engage with the container bodies, thereby increasing the number of container bodies to be collected.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A container formed with foldable and stackable container bodies, the container comprising:

a pallet having an upper surface and a lower surface, and a plurality of elongated grooves of predetermined pattern formed in the upper surface of the pallet; and a plurality of stackable container bodies, each container body formed with a wall member and defining a vacant inner space therein, each container body having corner surfaces, side wall surfaces, top edge surfaces, and bottom edge surfaces, said bottom edge surfaces having a plurality of protrusions formed thereon, said top edge surfaces having a plurality of slots formed therein at a corresponding location and in a coupling pattern with said protrusions so as to allow one of said container bodies to stack on another container body with the protrusions of said one container body inserted into the slots of the other container body, wherein said each container body includes a folding configuration formed and aligned in a vertical direction at an intermediate area of at least some of the side wall surfaces, thereof, allowing the container body to fold inwardly about the folding configuration so that its folded area is tucked inside towards a center of the container body to reduce its size in a horizontal direction upon folding, wherein said elongated grooves of the pallet include a group of the grooves matching with said protrusions of the container body when the container body is in an unfolded state, and allowing the container body to stack on the pallet with the protrusions of the unfolded container body inserted into the matching grooves of the elongated grooves, wherein said elongated grooves of the pallet include another group of grooves matching with said protrusions of the container bodies when the container bodies are in folded states with the side wall surfaces folded inwardly about the folding configuration and the size of the container bodies reduced in the horizontal direction, and allowing the container bodies to stack on the pallet with the protrusions of the folded container bodies inserted into the matching grooves of the elongated grooves to reduce their size for facilitating collection or delivery of the container with reduced size;

wherein the pallet includes a hopper stopper portion formed at a central area in the upper surface of the pallet, and a hopper is located within the container in a manner such that its lower portion is connected to the hopper stopper portion and the hopper is supported by the container bodies.

2. The container of claim 1, wherein said elongated grooves of the pallet have multiple sets of grooves configured to receive the protrusion of the multiple container bodies in the folded state, enabling to collect multiple container bodies folded and compactly overlapped on top of one pallet with the protrusions of the multiple container bodies securely engaged to the multiple sets of grooves of the pallet.

3. The container of claim 1, further comprising an RFID chip installed in the pallet.

4. The container of claim 1, further comprising a fastener configured to hold neighboring stacking container bodies together.

5. The container of claim 4, wherein said fastener is a combination of a coupling bracket attached to a bottom area of the container body and a fastening slot formed at a top area of the container body at a corresponding location for coupling with a neighboring coupling bracket.

6. The container of claim 5, wherein the coupling bracket includes a body portion reciprocally received in the container body, a fastening portion with a coupling protrusion, and an elastic member for biasing the body portion in one direction.

7. The container of claim 1, further comprising a cap for covering the container body.

8. The container of claim 7, wherein the cap includes projections on an upper surface thereof for allowing the protrusions of the container body to couple thereto.

9. The container of claim 1, wherein the pallet and the container body have a generally rectangular or square shape, and wherein the folding configuration is provided in two opposing side wall surfaces of the container body, among four side wall surfaces thereof.

10. The container of claim 1, wherein the folding configuration of the container body includes a connector configured to fold in one direction about the folding configuration of the side wall surface.

* * * * *